United States Patent [19]

Trowbridge et al.

[11] 3,962,949

[45] June 15, 1976

[54] TWIRLING BATON WITH BRAKE

[76] Inventors: Leonard D. Trowbridge; Naomi A. Trowbridge, both of 16200 Woodbridge, Harvey, Ill. 60426

[22] Filed: Feb. 27, 1975

[21] Appl. No.: 553,673

[52] U.S. Cl. ..... 84/477 B; 46/47

[51] Int. Cl.[2] ..... G09B 15/02

[58] Field of Search ..... 46/47, 72, 82, 84; 84/477 B; 128/67

[56] References Cited

UNITED STATES PATENTS 3,272,288 9/1966 Young ..... 188/67

3,636,811 1/1972 Bailey ..... 84/477 B

*Primary Examiner*—Louis G. Mancene
*Assistant Examiner*—Robert F. Cutting
*Attorney, Agent, or Firm*—Sabin C. Bronson

[57] ABSTRACT

A twirling baton with a handle mounted on an axis extending perpendicular to the axis of the baton shaft by which the baton may be twirled with minimal effort, said handle being equipped with braking means to quickly stop the rotation of the baton when desired.

4 Claims, 5 Drawing Figures

TWIRLING BATON WITH BRAKE

BACKGROUND AND SUMMARY

Twirling batons heretofore have been largely limited to use by those who have gained the necessary experience and skill to twirl the baton by manipulating the fingers. This required seemingly endless practice, during which the baton might slip from the fingers and strike an adjacent person also in a marching unit, for example.

The baton of the present invention is of the toy category, or at least for use by the younger students who are just beginning to experience the thrill and activity associated with athletic contests, etc.

Many twirling batons have been patented heretofore and reference is here made to U.S. Pat. No. 2,988,949 of June 20, 1961, and to U.S. Pat. No. 3,636,811 of Jan. 25, 1972, as illustrating the type of twirling baton to which our invention relates. There are instances where experienced baton twirlers may be in marching units which come to a sudden halt, at which time it may be difficult to suddenly bring the twirling baton to a halt.

It is therefore, an object of our invention to provide a brake associated with the handle of the baton whereby to quickly stop the rotation of the baton when desired.

DESCRIPTION OF THE PREFERRED EMBODIMENT

Figure 1:
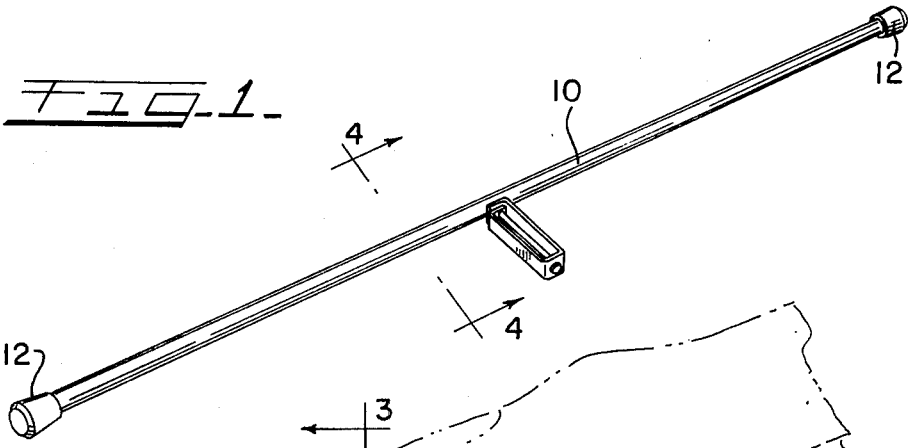
FIG. 1 is a perspective view of a baton having a handle formed in accordance with our invention.

Referring to FIG. 1, a conventional baton shaft 10 is shown having weights 12 of equal mass, fixed at either end. At the center of the shaft, one end of a spindle 14 is inserted into the shaft, perpendicular to the axis of the shaft, and so as to be non-rotatable therein. This spindle 14 forms the axis of the handle rotatably mounted thereon.

Figure 2:
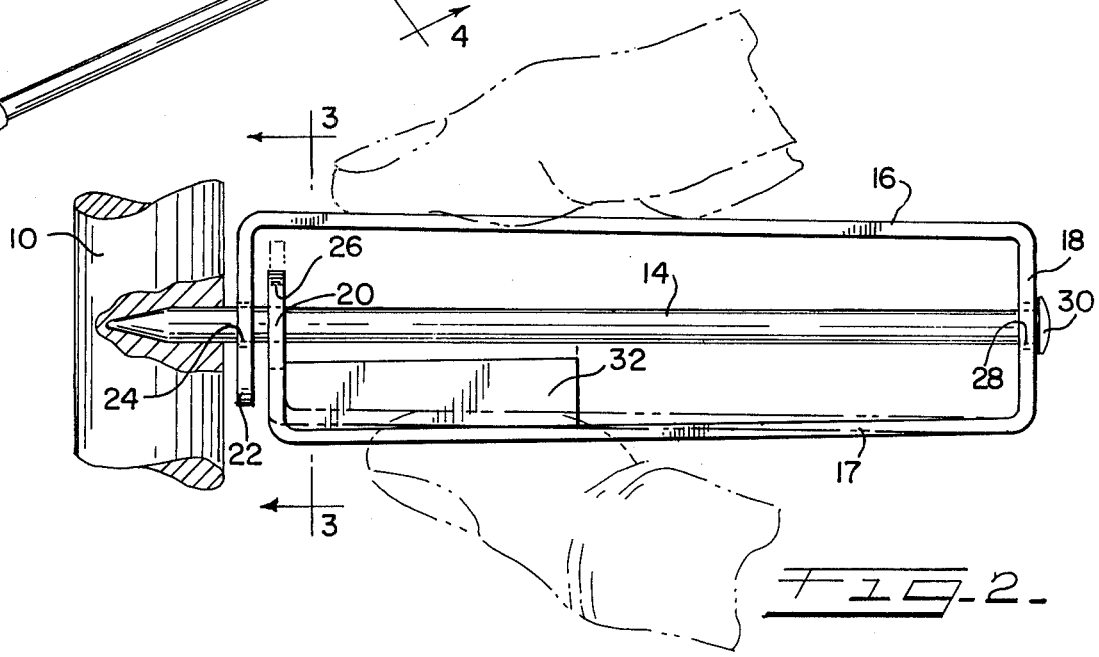
FIG. 2 is an enlarged side elevational view of the handle of the baton showing the braking feature thereof.

The handle is simply a piece of strap metal about one-half inch in width and seven inches long. This strap is bent upon itself into U-shape as indicated in FIG. 2, forming legs 16–17, and web 18. The free ends of the legs 16–17 are bent at right angles thereto forming flanges 22 and 20, respectively, which overlap each other as shown in FIG. 2. Flange 22 has a circular opening 24 therein through which the spindle 14 extends and rotates therein as a journal. Flange 20 has an elongated opening 26 therein through which the spindle 14 also extends and rotates therein. Finally the web 18 of the handle has a central opening 28 therein axially aligned with opening 24, which openings 24 and 28 form the bearings for the spindle 14. The spindle 14 extends through opening 28 and has a head 30 formed on the end thereof to hold the handle in place on the spindle.

Figure 3:
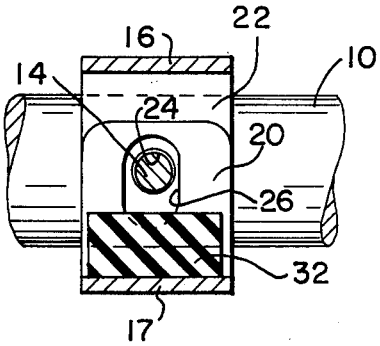
FIG. 3 is an enlarged cross sectional view on the line 3—3 of FIG. 2.
Figure 4:
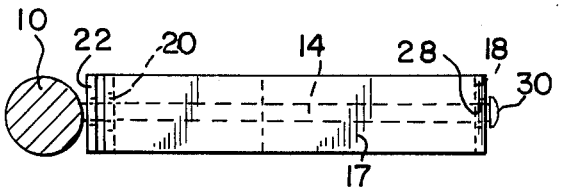
FIG. 4 is a slightly enlarged cross sectional view on the line 4—4 of FIG. 1.
Figure 5:
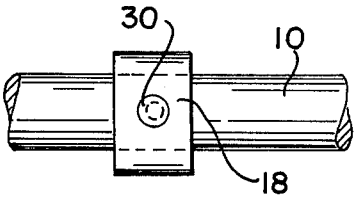
FIG. 5 is an end elevational view of the baton handle.

On the leg 17 and abutting the flange 20 is a block of brake lining material indicated at 32 which is spaced from the spindle 14 when the baton is being twirled. There are times, however, when the baton is twirling that it may be desired to stop the twirling motion quickly. In such event pressure may be exerted on the leg 17 to force it toward the rotating spindle until the brake lining 32 contacts the spindle 14 and by the friction generated quickly stop the spindle from rotating which also stops the baton from twirling. As will be seen from FIG. 3, the elongated opening 26 permits the pressing of the leg 17 and the brake lining 32 toward and against the spindle 14.

The brake lining material is removably attached to the handle so that it may be conveniently replaced when worn or for any reason.

From the above and the accompanying drawing, it is believed one versed in the art can readily understand the structure of this invention and how it operates.

We claim:

1. A twirling baton comprising in combination an elongated shaft, a spindle anchored at one end in said shaft, midway between its ends, and extending normally therefrom, a handle mounted on said spindle for rotation of said spindle therein, said handle being compressible against said spindle to stop rotation thereof.

2. The structure as set forth in claim 1 wherein brake means is associated with said handle for engagement with said spindle upon compression of said handle.

3. The structure of claim 2 wherein said brake means comprises brake lining material removably attached to said handle.

4. The structure as set forth in claim 1 wherein said handle comprises a U-shaped length of strap metal bent to form legs connected by a web, overlapping flanges formed at the free ends of the legs, registering openings in the flanges and web for mounting said handle on the spindle.

* * * * *